United States Patent [19]

Folsom

[11] 4,136,664

[45] Jan. 30, 1979

[54] STOVE

[76] Inventor: Terrance R. Folsom, S. 4015 Conklin St., Greenacres, Wash. 99016

[21] Appl. No.: 850,420

[22] Filed: Nov. 10, 1977

[51] Int. Cl.[2] ..... F24C 15/08

[52] U.S. Cl. ..... 126/64; 126/65; D23/97; 52/DIG. 10

[58] Field of Search ..... 126/60, 61, 62, 63, 126/64, 65, 66, 58, 4, 6; D23/97, 93; 52/DIG. 10

[56] References Cited

U.S. PATENT DOCUMENTS

| | | | |
|---|---|---|---|
| 142,270 | 8/1873 | Patterson | 126/72 |
| 201,238 | 3/1878 | Gemmell | 126/64 |
| D. 219,655 | 1/1971 | Salvador | D23/97 |

*Primary Examiner*—Bernard A. Gelak

*Attorney, Agent, or Firm*—Wells, St. John & Roberts

[57] ABSTRACT

A freestanding space heating stove, presenting heat radiating flat faces of essentially equal surface, the faces being alike pentagonal plates of steel joined edge to edge forming a dodecahedron shaped hollow body wherein one of the plates provides a bottom and supporting legs extend downwardly and outwardly from the edges of the bottom plate to support the stove above a supporting floor. The bottom plate has five like plates diverging upward from its five edges and these five plates each have their two upper edges joined to the two lower edges of two like plates. The five upper plates converge and have their top edges joined to a top plate. One of the upper plates is provided with a door to receive fuel. Also, two of the upper plates have air inlets provided with dampers. Outlet means for gases produced is provided at the point of the top plate opposite to the edge thereof which joins the door carrying upper plate.

5 Claims, 9 Drawing Figures

STOVE

BACKGROUND OF THE INVENTION

The present need for utilization of wood as a means of heating spaces because of the cost of oil and its ultimate unavailability has created a need for better wood stoves. This material can be grown and it is available to the individual home in the country. This necessitates the improvement of wood burning stoves that can be readily and safely supplied with pieces of wood without allowing smoke or ash readily to escape into the space being heated. Stoves heretofore available have not provided heat radiation characteristics that can direct the radiation in the most advantageous way and still provide the above desired advantages.

BRIEF DESCRIPTION OF THE INVENTION

The invention provides a heater stove with radiation surfaces directing the radiation in such directions as to warm the surrounding air all around the stove. To accomplish this purpose the invention uses a surface shape which comprises a pentagonal dodecahedron with flat top and bottom faces arranged horizontally and each having less than ten percent of the heat radiating surface of the stove. The remaining ten pentagonal faces of the stove diverge from the top and the bottom flat faces and intersect in such fashion as to provide half of the walls inclined outward and upward from the bottom wall to direct the wood toward the middle of the firebox as the wood burns. Likewise this structure provides inclined upper surfaces for a fuel supply door and for a stove pipe opposite to the door. When inserting fuel the inclined surface around the door opening acts to support the wood pieces and the stove pipe outlet opposite to the door opening provides outlet passage for smoke above the door level.

Draft inlet means are provided in the upper inclined walls. To preheat the air entering through air inlet, a plate is secured above the inlet opening and extends across the angle between two adjacent lower flat walls terminating above the bottom wall. For supplying air above the burning wood to complete combustion in the firebox a second air inlet means is provided in a lower part of one of the upper inclined walls spaced from the wall having the first inlet means therein.

GENERAL DESCRIPTION

Figure 1:
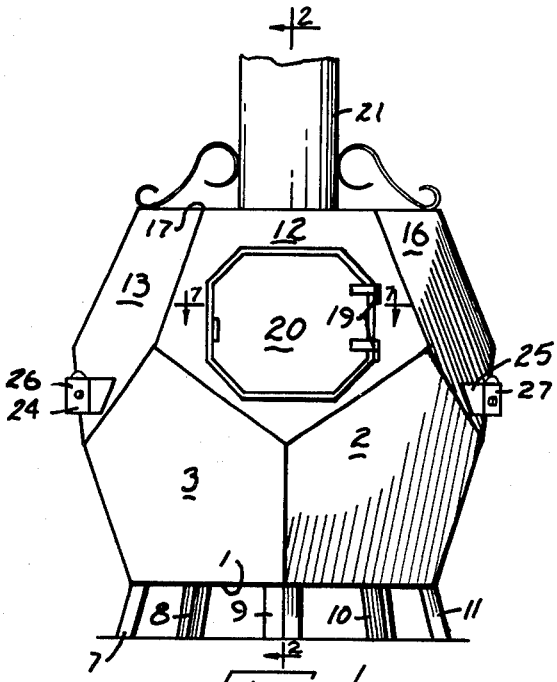
FIG. 1 is a front view of a stove embodying my invention.
Figure 2:
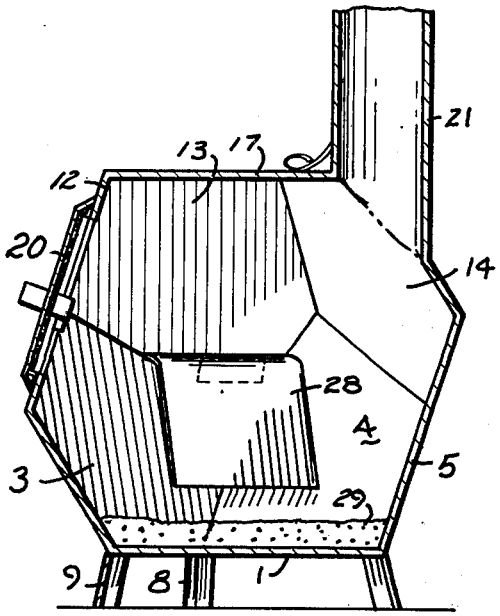
FIG. 2 is a sectional view taken on the line 2—2 of FIG. 1.
Figure 3:
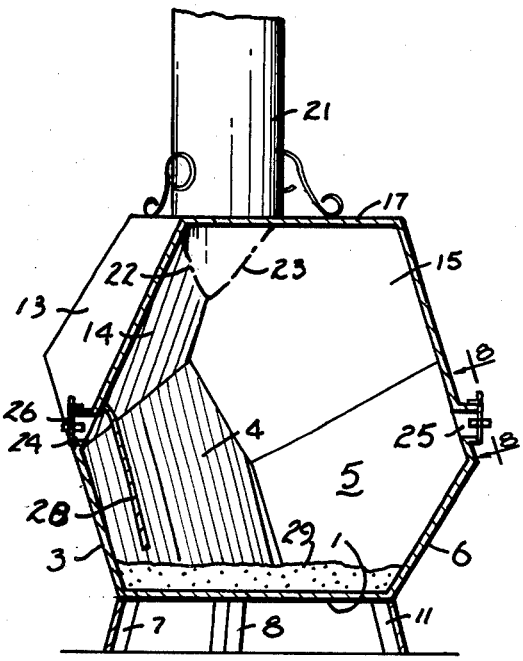
FIG. 3 is a sectional view taken on the line 3—3 of FIG. 4.
Figure 4:
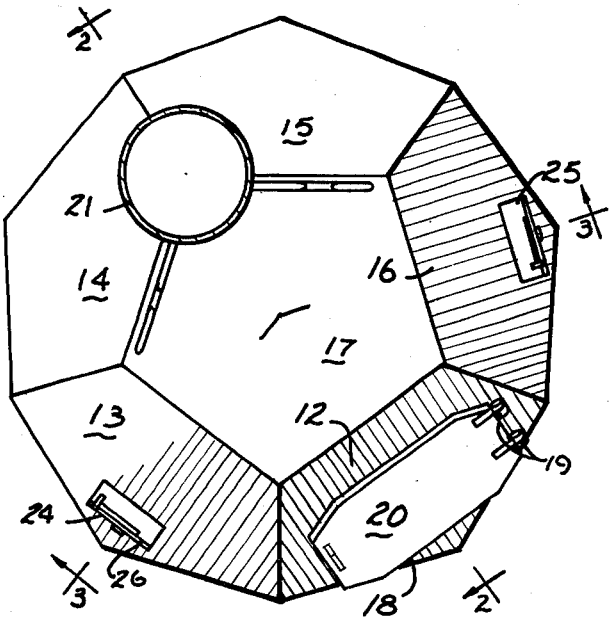
FIG. 4 is a top plan view of the stove.

The stove embodying the present invention is made of heavy steel plate and comprises basically a series of twelve like plates each of pentagonal shape. A bottom plate 1 is joined along its five edges by five alike lower plates 2, 3, 4, 5 and 6. Five supporting legs 7, 8, 9, 10 and 11 are secured to the bottoms of the lower plates in proximity to the corners where the lower plates meet the bottom plate and the adjacent lower plates. These supports diverge downwardly and are long enough to provide a stable support for the stove. The five lower plates and the bottom plate 1 are joined so that together they provide a pan shaped receptacle in which the five lower plates diverge upwardly from the bottom plate.

The stove enclosure is completed by five upper pentagonal plates 12, 13, 14, 15 and 16 like the bottom plate 1 and the lower plates 2, 3, 4, 5 and 6, and by a top plate 17 also like the bottom plate 1. Two lower edges of each upper plate are joined to adjacent upper edges of two lower plates. The five upper plates converge to cause their upper edges to meet the five edges of the top plate 17. The edges of the five upper plates are secured to the edges of the plate 17. This structure provides a hollow firebox and heat radiation structure which comprises a pentagonal dodecahedron.

A fuel inlet opening 18 is provided in the upper plate 12 and this opening is provided with a door 20 to swing outward on hinges 19. Since the plate 12 is inclined toward the interior of the structure, it enables one to put wood pieces into the firebox more readily than is possible in stoves having the fuel opening in the top or in a vertical side. Also the door when closed has no tendency to swing open. The fuel opening 18 is spaced down below the top plate 17.

The outlet of gases and smoke from the stove is provided by a pipe section 21 sealed to the top plate 17 and to adjacent edges 22 and 23 of upper plates 14 and 15. This provides an outlet opening into the pipe section 21 that is opposite to, and the top of which is above the level of the opening 18. Thus the smoke and gases are directed away from the door opening 18 to keep them from escaping through the door opening into the space being heated.

Draft openings are provided at 24 and 25 in the upper plates 13 and 16 near the lower tips of these plates. A damper 26 is provided for the opening 24 and a like damper 27 is provided for the opening 25. A cover sheet 28 is extended from the plate 13 downwardly and across the lower plates 3 and 4 and sealed to the plates 13, 3 and 4 to provide an air heating passage from the draft opening 24 down to the lower portion of the firebox below the lower edge of the sheet 28. The opening 25 has no cover sheet over it so that the air entering through opening 25 provides over-fire air to complete the combustion of gases over the burning wood.

This stove should have a noncombustible deposit 29 of ash or clay in the bottom as indicated to restrict the amount of heat being radiated downward from the bottom wall 1. Removal of excess ash is done through the fuel inlet opening 18.

Figure 5:
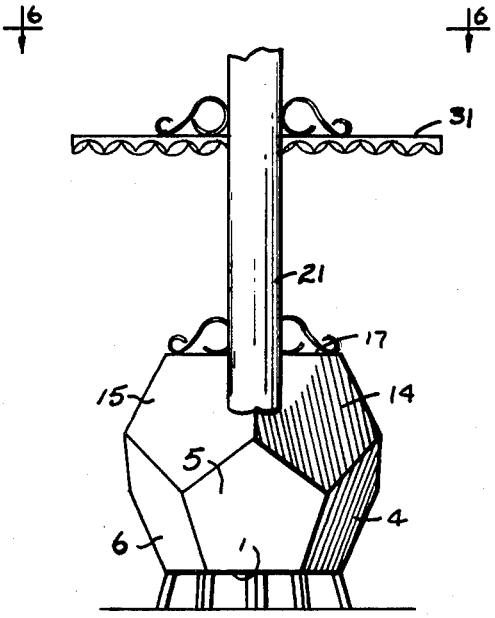
FIG. 5 is a rear view of the stove showing a warming shelf therewith.
Figure 6:
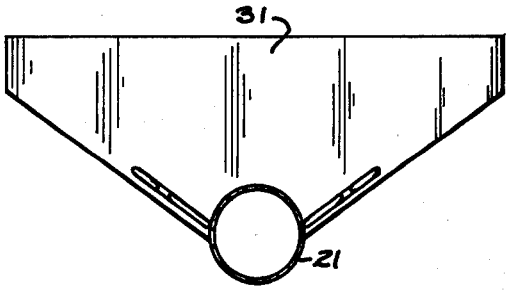
FIG. 6 is a plan view of the warming shelf.
Figure 7:
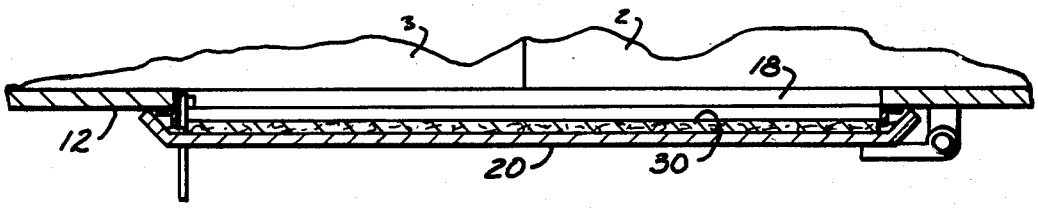
FIG. 7 is a detail sectional view taken on the line 7—7 of FIG. 1.
Figure 9:
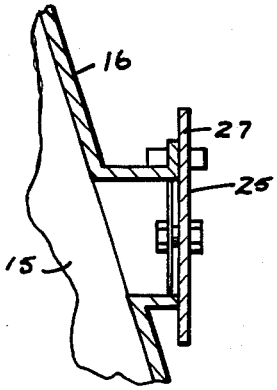
FIG. 9 is a fragmentary sectional view taken through the draft inlet.
Figure 8:
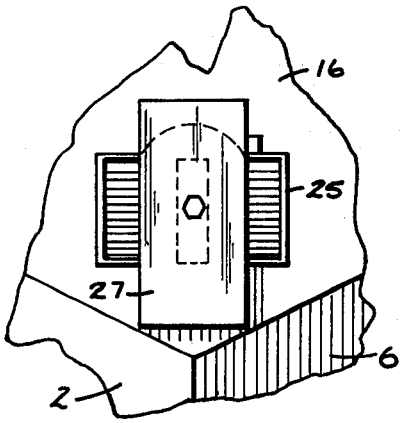
FIG. 8 is an enlarged detail view of one of the draft inlets.

This stove is particularly effective in keeping the wood together as it burns. The plates 2–6 all slope inward toward the bottom so the wood always falls toward the middle of the firebox eliminating the need for frequent poking of the fire. The combination of the large firebox with the oppositely disposed fuel inlet and outlet pipe provides excellent radiation all around the stove, convenient opening for fuel and avoidance of escaping ash or smoke into the space being heated. The door 20 can be and is shown to be interiorly lined with a sheet 30 of asbestos. It is also helpful to provide a floor covering of asbestos beneath the stove to prevent overheating of the floor. The flat top plate 17 can be used for simple cooking. A warming shelf 31 is shown in FIGS. 5 and 6. This shelf is useful for keeping items cooked on the plate 17 from getting cold.

I claim:

1. A stove comprising a hollow body of pentagonal dodecahedron shape with a bottom wall and a top wall parallel to each other;

the two walls being joined by five upwardly diverging lower walls and five upwardly converging upper walls joined to each other to complete the hollow body;

one of the upper walls having a fuel inlet opening therein spaced below said top wall;

a door covering said fuel inlet opening;

the stove having an outlet for the gases produced at the point of the top wall most remote from the full inlet opening.

2. The stove defined in claim 1 wherein adjustable draft means are provided in an upper wall.

3. The stove defined in claim 1 wherein the gas outlet comprises an upstanding pipe and a warming shelf is carried by the pipe.

4. The stove defined in claim 1 wherein the door covering the fuel inlet opening is hinged to the upper wall to swing about an inclined axis paralleling the said upper wall so that the weight of the door is directed against the fuel inlet opening.

5. The stove defined in claim 1 wherein the adjustable draft means includes a baffle wall inside the stove extending over the draft to direct air downward.

* * * * *